US009600014B2

(12) United States Patent
Marinca et al.

(10) Patent No.: US 9,600,014 B2
(45) Date of Patent: Mar. 21, 2017

(54) VOLTAGE REFERENCE CIRCUIT

(71) Applicant: ANALOG DEVICES GLOBAL, Hamilton (BM)

(72) Inventors: Stefan Marinca, Limerick City (IE); Gabriel Banarie, Limerick City (IE)

(73) Assignee: Analog Devices Global, Hamilton (BM)

( * ) Notice: Subject to any disclaimer, the term of this patent is extended or adjusted under 35 U.S.C. 154(b) by 355 days.

(21) Appl. No.: 14/272,061

(22) Filed: May 7, 2014

(65) Prior Publication Data

US 2015/0323950 A1 Nov. 12, 2015

(51) Int. Cl.
*G05F 3/30* (2006.01)
*G05F 3/16* (2006.01)

(52) U.S. Cl.
CPC . *G05F 3/30* (2013.01); *G05F 3/16* (2013.01)

(58) Field of Classification Search
CPC ..... G05F 3/30
See application file for complete search history.

(56) References Cited

U.S. PATENT DOCUMENTS 8,106,707 B2 * 1/2012 Katyal ..... G05F 3/30 323/313
2008/0088361 A1 4/2008 Kimura
2009/0121699 A1 5/2009 Park et al.

FOREIGN PATENT DOCUMENTS

CN 1725139 A 1/2006
CN 101169671 A 4/2008
CN 101901018 A 12/2010
CN 102369495 A 3/2012

OTHER PUBLICATIONS

"Chinese Application Serial No. 201510221871.0, Office Action mailed Apr. 25, 2016", 11 pgs.
"Chinese Application Serial No. 201510221871.0, Response filed Sep. 12, 2016 to Office Action mailed Apr. 25, 2016", (With English Translation), 20 pgs.

* cited by examiner

*Primary Examiner* — Hai L Nguyen
(74) *Attorney, Agent, or Firm* — Schwegman, Lundberg & Woessner, P.A.

(57) ABSTRACT

The present disclosure relates to a method and apparatus for generating a voltage reference. More particularly the present disclosure relates to a methodology and circuitry configured to provide an output signal that combines a proportional to absolute temperature component with a complimentary to absolute temperature component to generate a stable output which is not temperature dependent.

29 Claims, 11 Drawing Sheets

VOLTAGE REFERENCE CIRCUIT

FIELD

The present disclosure relates to a method and apparatus for generating a voltage reference. More particularly the present disclosure relates to a methodology and circuitry configured to provide an output signal that combines a proportional to absolute temperature component with a complimentary to absolute temperature component to generate a stable output which is not temperature dependent.

BACKGROUND

It is well known that temperature affects the performance of electrical circuitry and it is important to provide circuitry which provides an output which is not dependent on temperature fluctuations, i.e. a voltage reference. It will be appreciated that a voltage reference can be converted to current reference and for the sake of the following explanation the present teaching will be described with reference to the provision of a voltage reference at the output of the circuit but it will be understood that the present teaching should be construed as limited to such a voltage reference.

In the context of providing voltage references, it is known to use a band-gap type voltage reference which is based on a summation of two voltage components having opposite and balanced Temperature Coefficients (TCs). Usually, the first voltage component is related to a base-emitter voltage of a bipolar transistor which inherently has a form which is Complementary To Absolute Temperature, denoted as a CTAT voltage. The second voltage component is obtained from the base-emitter voltage difference, $\Delta V_{BE}$, of two bipolar transistors operating at different collector current densities. This voltage is Proportional To Absolute Temperature and it is denoted a PTAT voltage. Very often the base-emitter voltage difference is reflected over a resistor generating a corresponding PTAT current. With a second resistor of the same type (same TC) the base-emitter voltage difference is gained to the desired level to balance the CTAT voltage component.

A real voltage reference is affected by many errors such as temperature drift or temperature coefficient (TC). Such a variation in response with respect to operating temperature may be considered a first order variation but it is also possible for resultant errors to have a contribution from higher order error components. Such higher order errors can be very well approximated by a parabolic or second order form versus absolute temperature. To compensate for these errors there is always a need for a trimming circuit and a method to guarantee the target specifications independent of how the circuit is designed or its architecture.

In summary, there is a continuous need for circuits that can provide an accurate reference circuit.

SUMMARY

These and other problems are addressed by a voltage reference circuit provided in accordance with the present teaching. By judiciously combining circuit elements it is possible to generate a voltage or a current at an output node of the circuit that is temperature independent. The circuit elements include a first set of components that are configured relative to one another to provide an output of the form proportional to absolute temperature, PTAT. Desirably this first set of components comprises bipolar transistors and the components are configured to generate a signal that is proportional to a differential in base emitter voltages of two bipolar transistors, $\Delta V_{BE}$.

A second set of components are coupled to this first set of components. The second set of components operably provides an output that is complimentary to absolute temperature, CTAT, in form.

The present teaching provides for a coupling of the first and second set of components in a manner whereby a trimming of the second set of components at a single temperature can be used to compensate for errors introduced by process parameters and mismatch. As the first set of circuit components generates an output that is self-referencing, the PTAT is generated by a ratio of internal circuit components, this single trimming step is sufficient to provide a voltage reference at the output of the circuit that is, to a first order, temperature insensitive.

BRIEF DESCRIPTION OF THE DRAWINGS

Embodiments which are provided to assist with an understanding of the present teaching will now be described, by way of example, with reference to the accompanying drawings, in which.

DETAILED DESCRIPTION

The present teaching provides a reference circuit that combines the output from a first set of circuit elements with the output from a second set of circuit elements. The first set of circuit elements provides at least one proportional to absolute temperature, PTAT, cell which is configured to generate a voltage that is temperature dependent and specifically will increase with increased ambient temperature. The second set of circuit elements provides at least one complimentary to absolute temperature, CTAT, cell which is configured to generate a voltage that is temperature dependent and specifically will decrease with increased ambient temperature. By combining the PTAT and CTAT voltages from the first and second set of circuit elements the overall output of the circuit may be provided having no temperature sensitivities, i.e. it neither increases nor decreases with changes in ambient temperature. In this way the circuit provides a voltage reference.

Figure 1A:
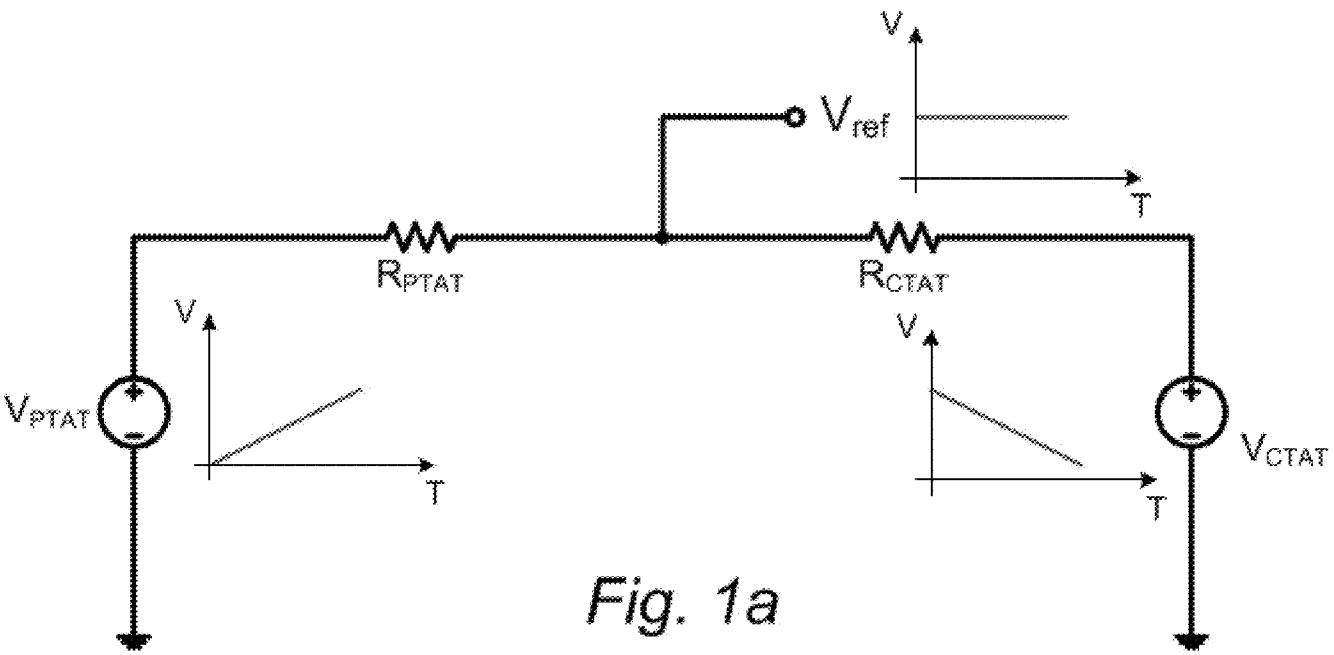
FIG. 1*a* is a schematic showing components of an illustrative circuit provided in accordance with the present teaching.
Figure 1B:
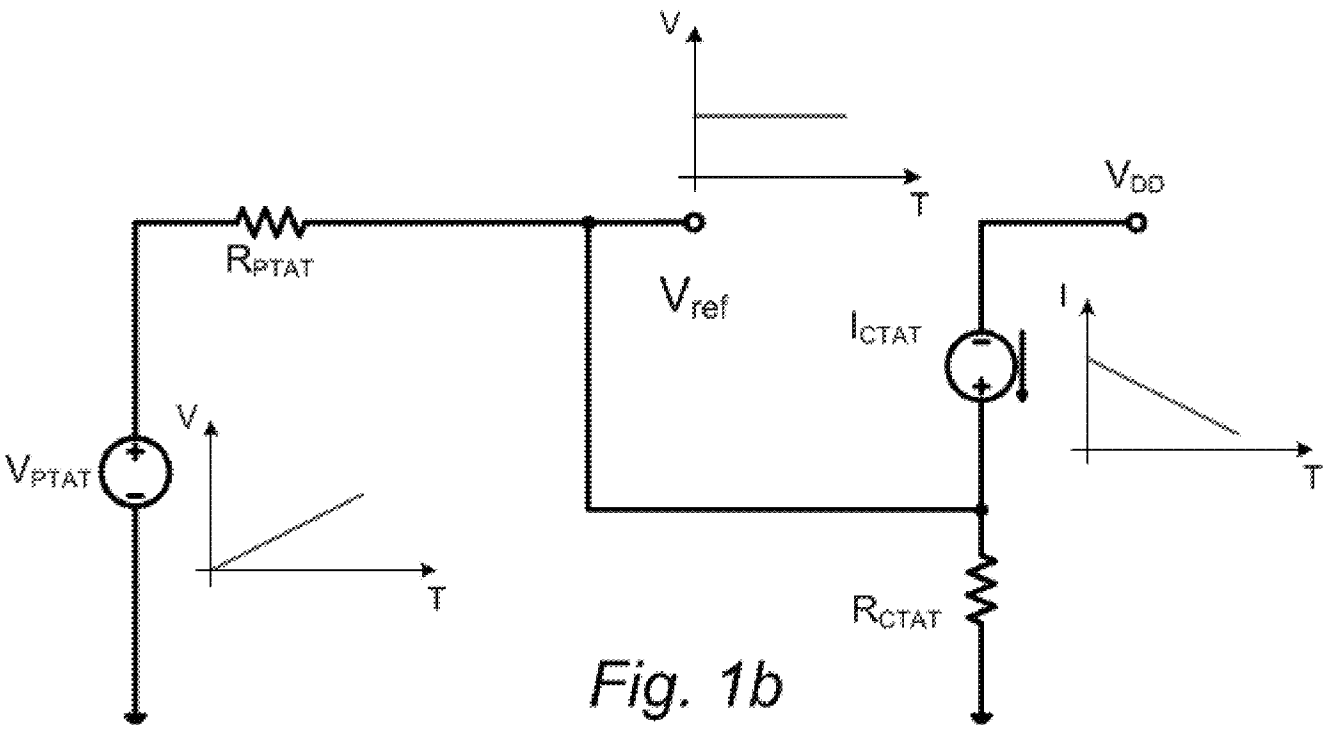
FIG. 1*b* is a schematic showing components of an illustrative circuit provided in accordance with the present teaching.
Figure 1C:
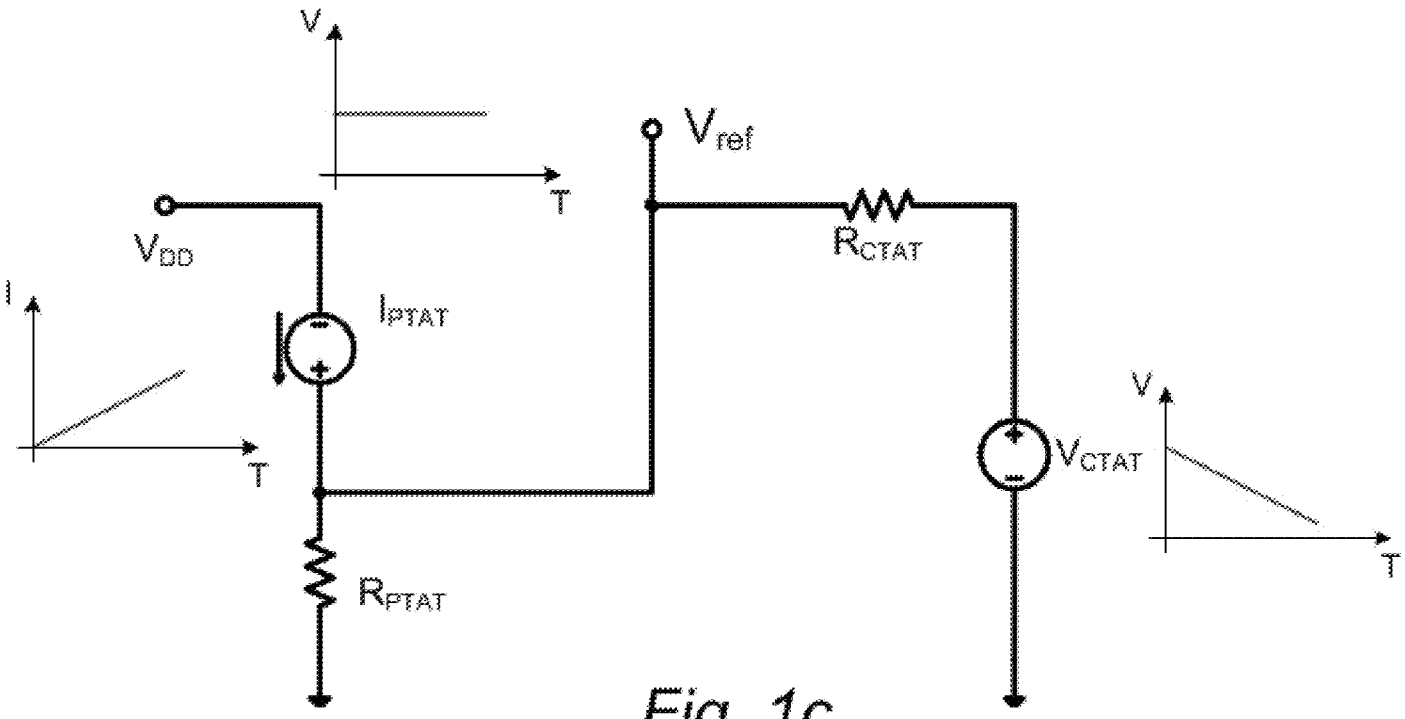
FIG. 1*c* is a schematic showing components of an illustrative circuit provided in accordance with the present teaching.

The present teaching will now be described with reference to exemplary arrangements. The exact implementation of a circuit per the present teaching may vary but the variances share a common architecture whereby, when making adjustments which are necessary as part of a trimming or calibration regime, the set of circuit elements that provide the PTAT component of the circuit are not altered. A basic block structure of an architecture that may be employed within the context of the present teaching is shown in each of FIG. 1*a*, FIG. 1*b* and FIG. 1*c*. FIG. 1*a* shows a set of circuit elements configured in a voltage mode, FIG. 1*b* shows a set of circuit elements configured in a CTAT current mode and FIG. 1*c* shows a set of circuit elements configured in a PTAT current mode. As was mentioned above, in all cases, any adjustments are made in such a way that the PTAT component, designed to be stable against variation of process parameters, is not altered.

The circuit of FIG. 1*a* provides two voltage components, one PTAT and one CTAT. Each of the two components is coupled to a common node, $V_{ref}$, via two resistors, $R_{PTAT}$ and $R_{CTAT}$. While shown in block schematic form, the underlying architecture that is used as this PTAT voltage component is selected such that the PTAT voltage component is very consistent, with minimum sensitivity to process variations and to local mismatches of its various circuit elements. For example, if the PTAT component is generated from a base emitter voltage difference between two bipolar transistors then the actual voltage is a relative term which self-compensates for variances in the individual elements which are used to generate the individual base emitter voltages. In this way, the PTAT voltage component can be considered as an internal reference inside the overall architecture of the reference circuit.

As was mentioned above, a circuit provided in accordance with the present teaching couples a PTAT component with a CTAT component in order to generate a temperature independent voltage, $V_{ref}$. As will be described in more detail below, the circuit is configured such that the PTAT component is provided by a first set of circuit components configured to generate a proportional to absolute temperature, PTAT, signal that is dependent on a base emitter voltage difference between first and second bipolar transistors operating at different current densities. This PTAT signal could be a voltage or a current signal. The CTAT component is provided by a second set of circuit components configured to generate a complimentary to absolute temperature, CTAT, signal which again could be a CTAT current or voltage. By arranging the PTAT component with the CTAT component it is possible to couple the CTAT signal component to the PTAT signal to provide at an output of the circuit an output voltage that is first order temperature insensitive. This coupling is typically provided by arranging the PTAT and CTAT components in a bridge configuration. Within the context of the present teaching the term "bridge configuration" is intended to define first and second legs of a circuit that are arranged relative to a shared tapping point such that changes in either of the two legs affects the signal at the shared tapping point. The PTAT component defines a first leg and the CTAT component defines a second leg, the shared tapping point being Vref, the output of the circuit.

By providing the PTAT and CTAT components in a bridge configuration the PTAT component can provide an internal reference for the circuit. Furthermore, use of the CTAT component alone can be sufficient to provide a calibration of the circuit. This calibration can be done by judiciously selecting the values of the circuit components that are used in the CTAT leg a priori to circuit manufacture. In this way, the value of the CTAT component is hard coded or hard wired into the circuit. In another configuration it is possible to trim or otherwise tune the value provided by circuit components of the CTAT component to vary its contribution to the overall sensed signal at the shared tapping point.

If the circuit is designed such that the PTAT component will not be varied as part of a trimming exercise to provide the desired voltage reference then the only circuit elements that may be varied are those that provide the second voltage component, $V_{CTAT}$. As the two voltage components, $V_{PTAT}$ and $V_{CTAT}$, have opposite temperature variations, i.e. different slopes vs. temperature, the two resistors, $R_{PTAT}$ and $R_{CTAT}$ can be arranged such that, at the common node $V_{ref}$, the voltage is first order temperature independent. In other arrangements, the value of the $R_{PTAT}$ and $R_{CTAT}$ resistors can be chosen carefully based on anticipated operating conditions of the circuit. In this way the adjustment can be performed directly on the CTAT component of the circuit which will mostly vary the temperature coefficient of the output voltage. In the event that the absolute value of the output voltage needs to be changed or the trimming range of the CTAT component needs to be adjusted, then the tapping point which provides the output voltage of the circuit and is located between the $R_{PTAT}$ and $R_{CTAT}$ resistors can be moved.

In a similar fashion a temperature independent voltage can be generated based on the block schematics of FIG. 1*b* and FIG. 1*c*. In the block diagram of FIG. 1*b*, the PTAT voltage, $V_{PTAT}$, is combined with a CTAT current, $I_{CTAT}$ and a resistor, $R_{CTAT}$. The reference voltage $V_{ref}$ can be trimmed to be temperature independent by adjusting the CTAT current or, for a fixed CTAT current, by adjusting the value of the resistor $R_{CTAT}$. In one particular case of this exemplary arrangement $R_{CTAT}$ can be omitted and the adjustment of $V_{ref}$ may be provided through adjustment solely of the $I_{CTAT}$.

Similarly, a CTAT voltage can be combined with a PTAT current. Such a circuit is shown in FIG. 1*c* and may be usefully employed to generate a temperature independent voltage, $V_{ref}$. While a resistor $R_{PTAT}$, is shown in the schematic of FIG. 1*c*, such a resistor can be omitted. Similarly to that described above with respect to FIG. 1*a* and FIG. 1*b*, any adjustment of the reference voltage is performed via the CTAT leg of the circuit, be that the actual CTAT voltage or $R_{CTAT}$.

Per the present teaching, the PTAT cell is used as an internal reference with the result being that other circuit elements of the circuit are referenced relative to the PTAT cell. In this way adjustments to the circuit output are achieved by varying other circuit elements of the circuit—be that the CTAT voltage reference cell or the resistors.

A CTAT cell typically provides an output that is based on the base emitter voltage of a bipolar transistor and can therefore be considered a voltage that is very much process dependent and also sensitive to mismatches. It also has a quite significant non-linear variation vs. temperature, very often of the form of T log T, where T denotes absolute temperature. By focusing on a trimming or other modification of the circuit elements that form this CTAT cell it is possible to compensate for these variances. At the same time the circuit elements that are used to provide the PTAT voltage cell can be selected based on their precision and independence to variance.

Figure 2A:
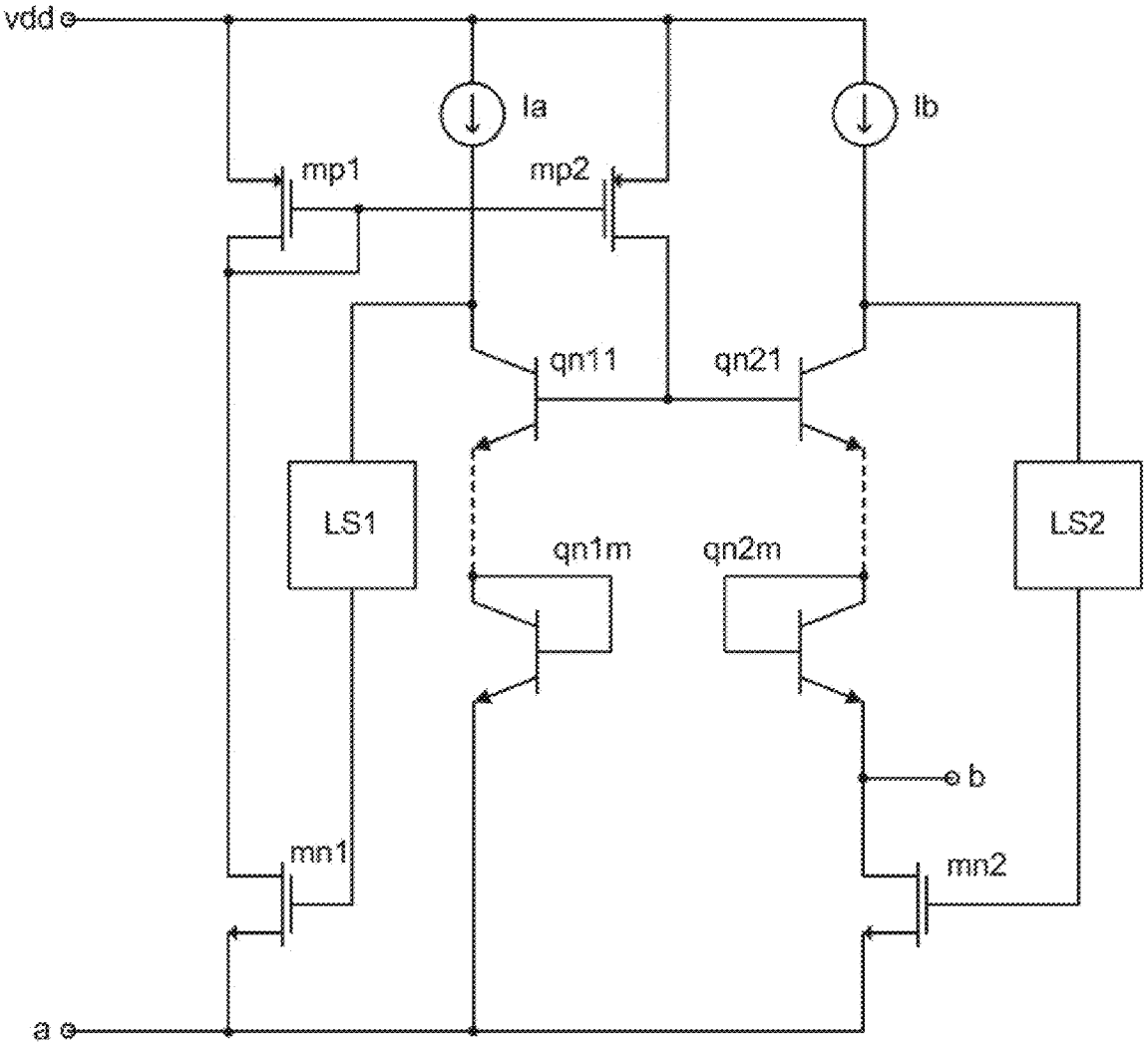
FIG. 2*a* is a schematic showing detail of circuit components configured to generate a PTAT output in accordance with the present teaching.

FIG. 2*a* shows an example of such a precise and process independent PTAT voltage generator which can be usefully employed as a PTAT cell within the context of the voltage reference of the present teaching. The architecture of this PTAT cell is similar in form to that described in U.S. Pat. Nos. 8,228,052 and 8,531,169, the content of each of with is incorporated by way of reference.

In the circuit of FIG. 2*a* the PTAT cell comprises two arms: a high collector current density arm and a low collector current density arm. The high collector current density arm consists of a stack of m unity emitter area bipolar transistors, qn11 to qn1*m*, biased with the same current, $I_a$. The low collector current density arm consists of a similar stack of m bipolar transistors, qn21 to qn2*m*, each having n times larger emitter area compared to the corresponding devices in the first arm. The low collector current density arm is biased with a current $I_b$, assumed to have the same temperature dependency as $I_a$. The base currents of the top pair of bipolar transistors q11 and q21 are supplied from a transconductance amplifier made of a level shifter, LS1, an NMOS transistor, mn1, and two PMOS transistors, mp1 and mp2. The base-emitter voltage difference between the two bipolar transistor stacks is developed across mn2, from drain to source. This voltage is:

$$\Delta V_{be} = m\frac{kT}{q}\ln(n), \tag{1}$$

where

- m corresponds to the number of bipolar transistors in a stack;
- n represents the collector current density ratio from the two arms;
- k is Boltzmann's constant;
- T is absolute temperature;
- q is the electron charge.

Figure 2B:
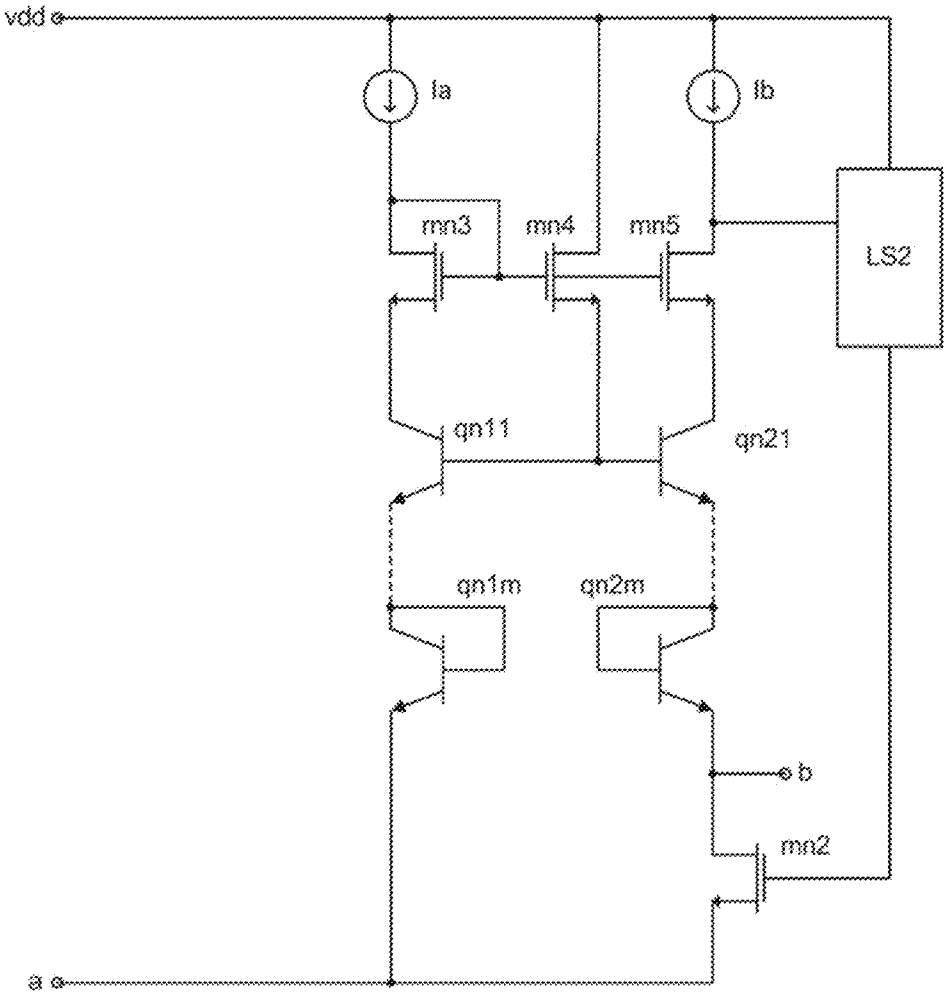
FIG. 2*b* is a schematic showing detail of circuit components configured to generate a PTAT output in accordance with the present teaching.

FIG. 2*b* shows another circuit that could be used in the context of the present teaching to provide the PTAT leg. The difference between the two structures consists of the method of providing the base current for the top pair of bipolar transistors, will and qn21. Transistor mn4 is used to generate the base currents of will and qn21. A transistor connected in this configuration is usually called a "beta-helper". The other two NMOS transistors mn3 and mn5 are used to balance the base-collector voltages of will and qn21, thus minimizing the effect of the so called direct Early voltage. The Early effect generates a second order error in the base-emitter voltage. The trade-off between the structures presented in FIG. 2*a* and FIG. 2*b* is better control of the Early effect at the expense of increased headroom requirements.

Based on headroom limitation, a corresponding number of the cells according to FIG. 2*a* and/or FIG. 2*b* can be stacked on top of each other to generate a large PTAT voltage. There are important advantages in generating a larger PTAT voltage by means of stacking. It is critically important that the PTAT voltage is generated without amplifiers which introduce errors and noise. As the number of individual cells increases, the effect of associated errors decreases due to the averaging effect. If the number of cells in a stack is l, the compound PTAT voltage increases by a factor of l and the noise increases only by a factor of $\sqrt{l}$.

Figure 3:
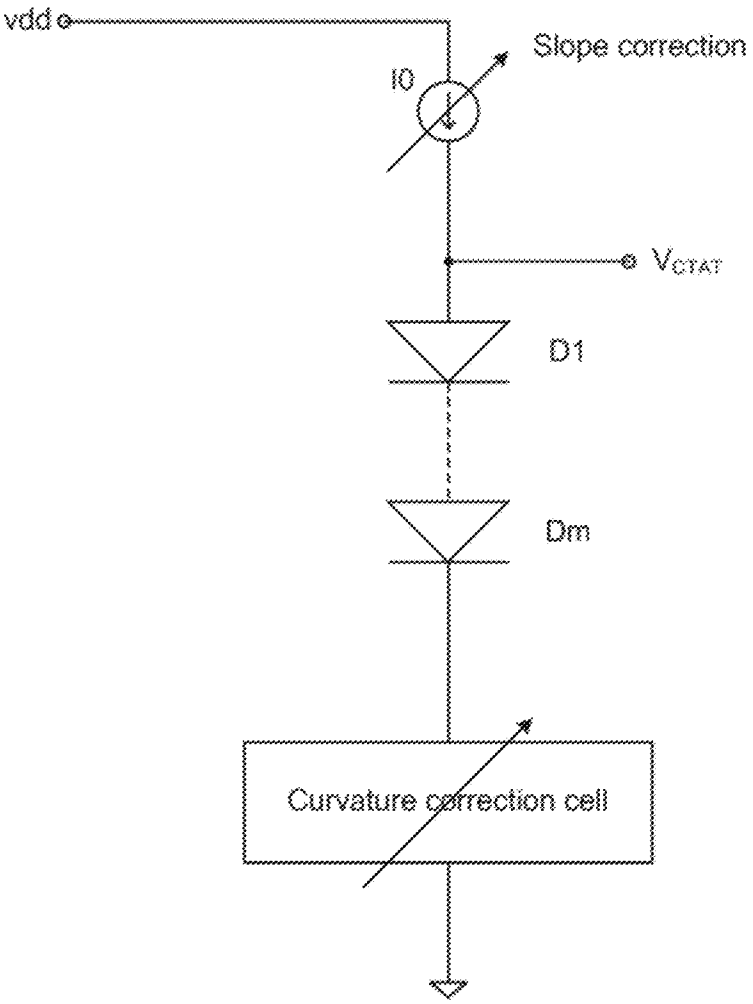
FIG. 3 is a schematic showing detail of circuit components configured to generate a CTAT output in accordance with the present teaching.

FIG. 3 presents a block diagram of a CTAT voltage cell according to an aspect of the present teaching. An adjustable current $I_0$ is used to bias a stack of forward-biased diodes, D1 . . . Dm where m is the number of diodes in the stack. Such a stack could be implemented using bipolar transistors. A curvature correction cell, $V_{cv}$, is coupled in series with the stack of diodes and this $V_{cv}$ cell may also be trimmable. The CTAT voltage component can be developed across the full stack consisting of the curvature correction cell and the stack of diodes, D1 . . . Dm. The bias current $I_0$ and the curvature correction voltage are trimmable, such that the generated voltage component $V_{CTAT}$ can be adjusted precisely to compensate for errors introduced by process parameters and mismatch.

Figure 4:
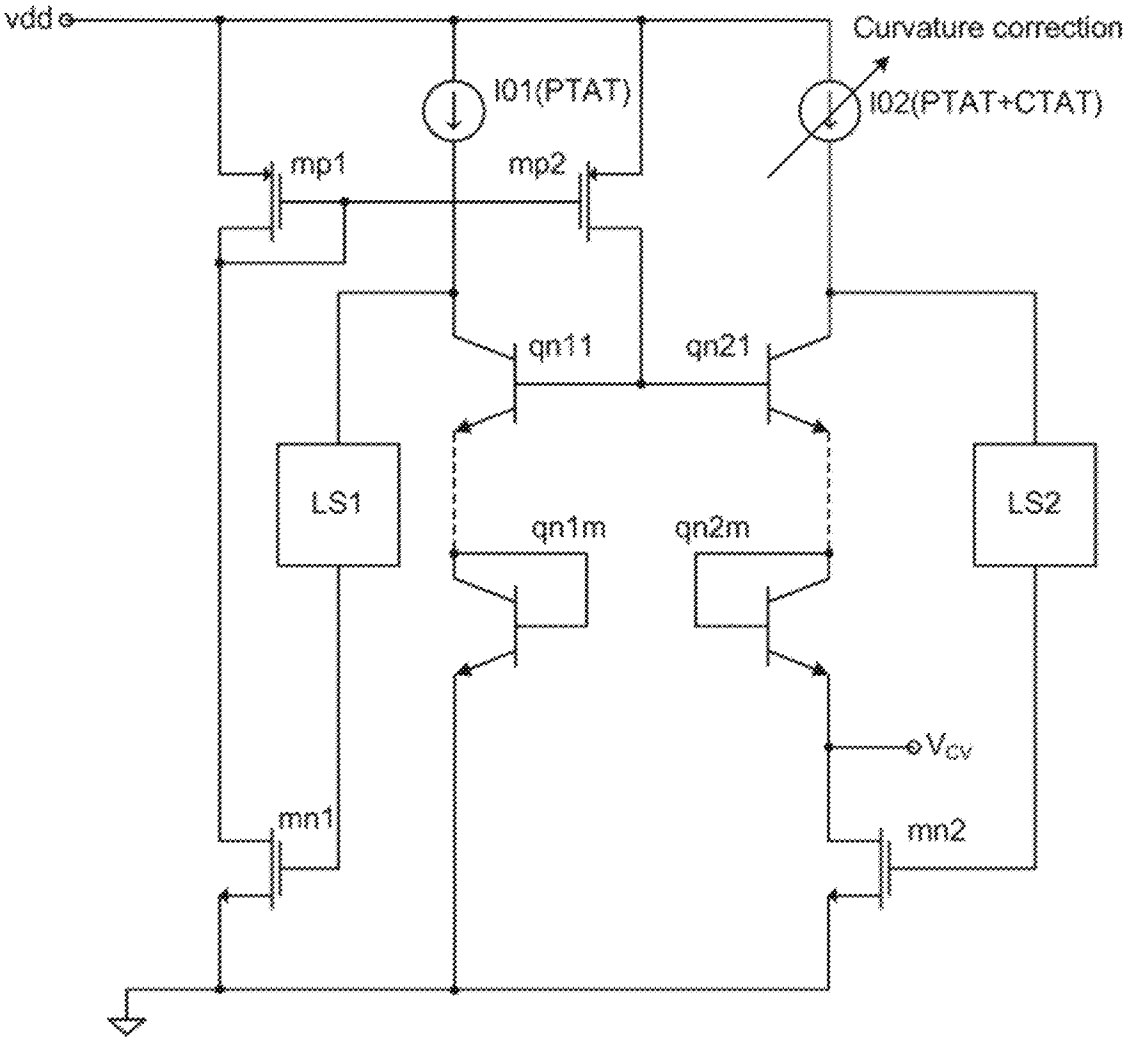
FIG. 4 is a schematic showing how circuit components can be combined to provide a curvature correction cell in accordance with the present teaching.

An exemplary schematic of circuit elements that could be provided in a curvature correction cell, $V_{cv}$, in accordance with the present teaching is shown in FIG. 4. This cell includes elements similar in form to the elements described in the cell presented in FIG. 2*a*. Two diode stacks of similar bipolar transistors operating at different collector current densities are arranged to provide a higher collector current density arm and a lower collector current density arm, where the terms higher and lower are relative terms determined with respect to the collector current density of the other arm. The high collector current density arm comprises a stack of bipolar transistors, q11 to q1*m*, where m is the number of transistors in the stack. The stack is biased by the PTAT current $I_{01}$. The lower collector current density arm comprises a stack of bipolar transistors, q21 to q2*m*, where again m is the number of transistors in the stack. This stack is biased by a trimmable combination of PTAT and CTAT currents, denoted $I_{02}$. The two arms are arranged relative to one another such that a base-emitter voltage difference is developed on the low collector current density side.

The overall correction to the curvature is based on an understanding that the nonlinearity of the base-emitter voltage versus temperature is dependent of the slope of the bias current as can be seen in Eq. 2:

$$V_{be}(T) = V_{g0} - (V_{g0} - V_{be}(T_0)) - \sigma\frac{kT}{q}\ln\frac{T}{T_0} + \frac{kT}{q}\ln\frac{T}{T_0}, \tag{2}$$

where

- $V_{be}(T)$ is the base-emitter voltage of a bipolar transistor at absolute temperature, T;
- $V_{g0}$ is the extrapolated band-gap voltage value;
- $V_{be}(T_0)$ is the base-emitter voltage of the bipolar transistor at absolute temperature, $T_0$;
- σ is the temperature coefficient of the saturation current of the bipolar transistor.

If the high collector current density arm of the correction circuit is biased with PTAT current and the low collector current density arm is biased with constant current from each pair of bipolar transistors, the expression of the base-emitter voltage presented in equation (1) has an additional term:

$$\Delta V_{be} = m\frac{kT}{q}\ln(n) + m\frac{kT}{q}\ln\frac{T}{T_0} \tag{3}$$

By trimming the ratio of PTAT to CTAT in the combined current source, $I_{02}$, the second term in equation (3) is adjusted, such that the nonlinear term of the base-emitter voltage in equation (2) is cancelled and the compound $V_{CTAT}$ voltage has only linear variation versus temperature. It will be appreciated that where employed such logarithmic temperature coefficient or curvature correction is typically done prior to determination of the optimum settings for temperature coefficient correction.

The output voltage of the circuit in FIG. 1*a* is $$V_{ref} = \frac{R_{CTAT}}{R_{PTAT} + R_{CTAT}} V_{PTAT} + \frac{R_{PTAT}}{R_{PTAT} + R_{CTAT}} V_{CTAT} \quad (4)$$

The ratio $R_{PTAT}/R_{CTAT}$ can be trimmed by choosing an adjustable tapping point on the resistor string implementing $R_{PTAT}+R_{CTAT}$ where the output voltage is collected.

It will be apparent that the circuits presented in FIG. 1*b* and FIG. 1*c* are mathematically equivalent to the circuit presented in FIG. 1*a* by means of simple Norton-Thevenin transformations.

Figure 5:
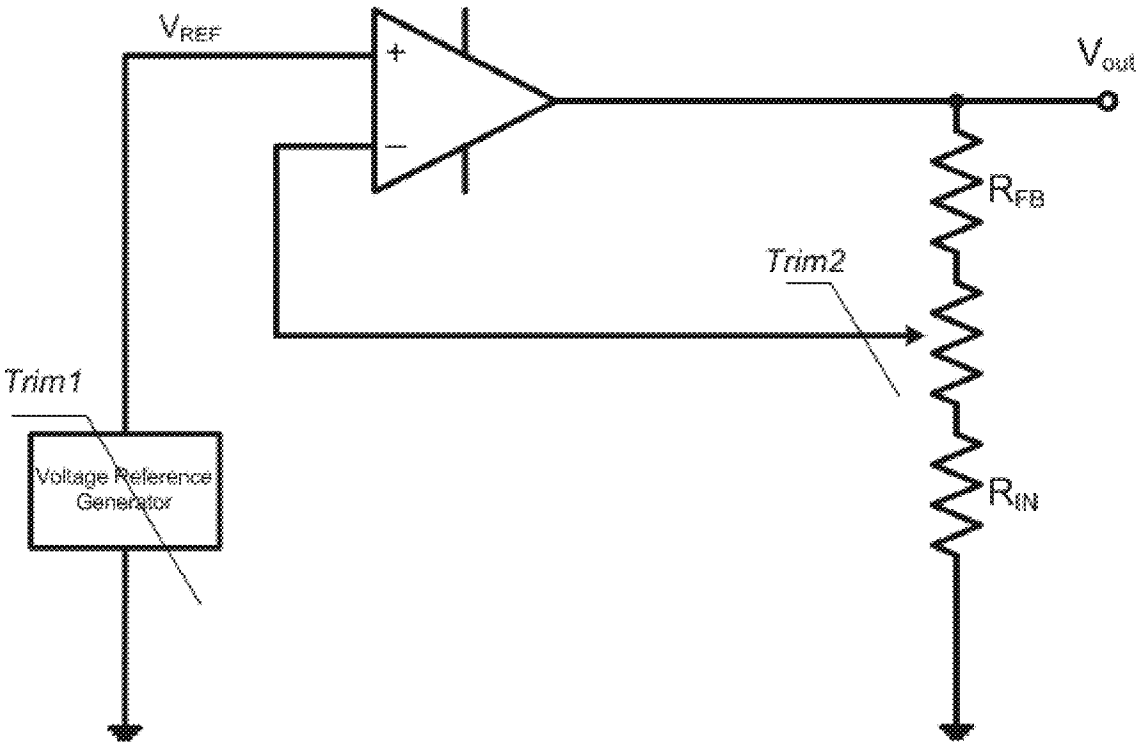
FIG. 5 is a schematic show circuit elements that may be usefully employed in a circuit provided in accordance with the present teaching.

Using circuits provided per the teaching of FIGS. 1 to 4 it is possible to provide a voltage reference generator which is trimmed at one temperature to provide the desired voltage reference at the output. Such an output can be buffered and by coupling the voltage reference generator to a buffered output it is possible to provide a second trim point. An example of such a buffered output voltage is shown in FIG. 5 where the block Voltage Reference Generator may be considered as comprising circuit elements such as heretofore described. The output of this voltage reference generator provides a voltage reference, $V_{REF}$, which is coupled into the positive input of an amplifier so as to provide a buffered output. The amplifier is desirably an adjustable gain amplifier whose gain can be adjusted to provide a second trim point for the overall circuit. In one configuration of such an adjustable gain amplifier, the amplifier's inverting input is coupled via a resistor string $R_{FB}$, $R_{IN}$ in a feedback loop configuration to the output of the amplifier, $V_{OUT}$. The point at which the inverting input is coupled to the resistor string may be varied to provide the second trim point for the overall voltage reference circuit. A trimming of the first trim point (which is provided by the CTAT component of the circuit) and the second trim point at a single temperature provides variance in the temperature coefficient and absolute value of the output voltage. A trimming at a second temperature may be used to improve accuracy in the temperature coefficient and absolute value of the output voltage.

Figure 6:
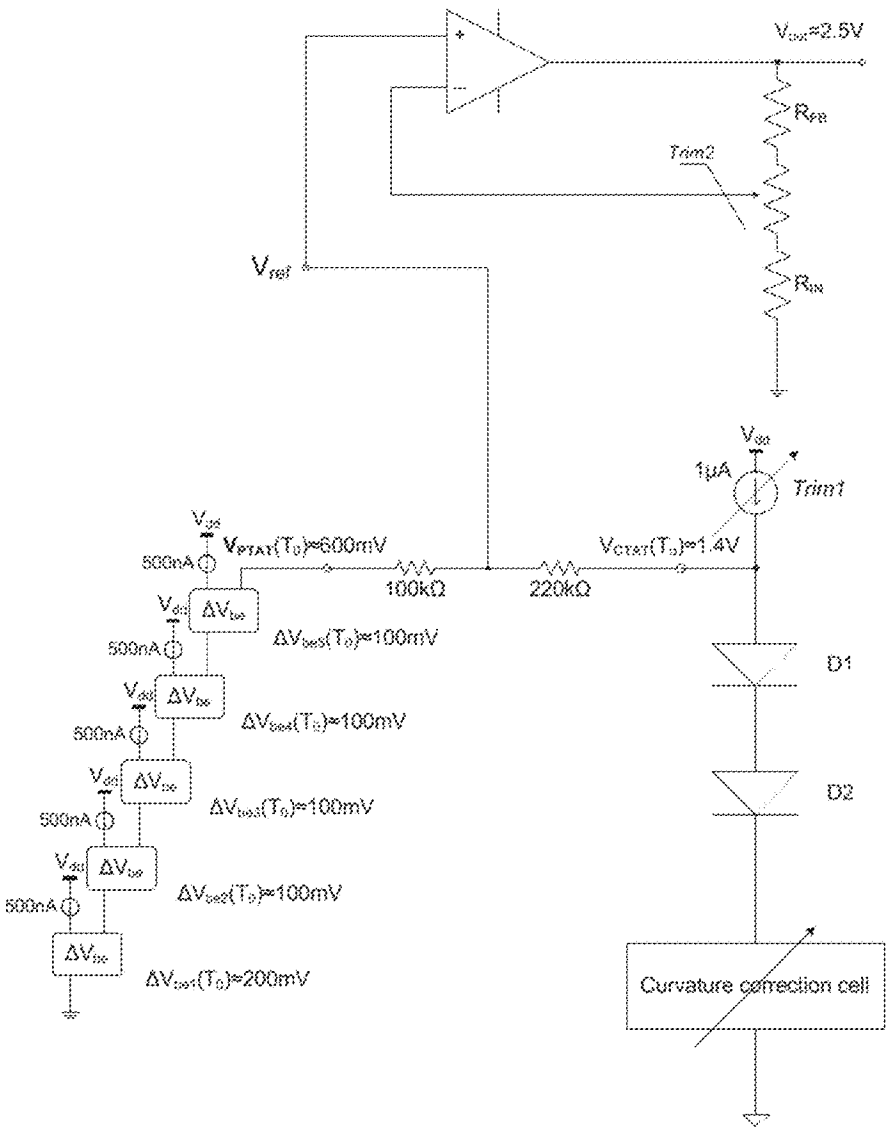
FIG. 6 is an exemplary illustration of how a plurality of PTAT cells can be stacked relative to one another to increase the PTAT contribution to a circuit provided in accordance with the present teaching.

FIG. 6 shows an example of such a circuit which was manufactured in a standard 0.18 μm CMOS process and evaluated. A $V_{PTAT}$ component generator was implemented as a stack of l=5 cells. The first cell used a topology similar to that described above with reference to FIG. 1*b*, with m=2, n=48, Ia=500 nA and Ib=500 nA providing a $\Delta V_{be}$ contribution to the overall stack of 200 mV. As the available headroom decreased, the next three cells used a topology such as that presented in FIG. 1*b* but in this implementation with m=1, n=48, Ia=500 nA and Ib=500 nA. Each of these cells provided a $\Delta V_{be}$ contribution of 100 mV. Due to further headroom constraints, the fifth cell used a topology such as that presented in FIG. 1*a* with m=1, n=48, Ia=500 nA and Ib=500 nA, to provide a $\Delta V_{be}$ contribution of 100 mV. It will be appreciated that these voltage values are at ambient temperature.

The $V_{CTAT}$ component generator was implemented using a topology similar to that described above with reference to FIG. 3 with m=2 and I0=1 μA nominal. A curvature correction cell was implemented and used m=2, n=25/4, I01=500 nA and I02=500 nA nominal. Each of the two resistors $R_{PTAT}$ and $R_{CTAT}$ were implemented as poly-silicon resistors having values: $R_{PTAT}$=100 kΩ and $R_{CTAT}$=220 kΩ. The desired output voltage of the circuit was determined to be of the order of 2.5V.

Figure 7A:
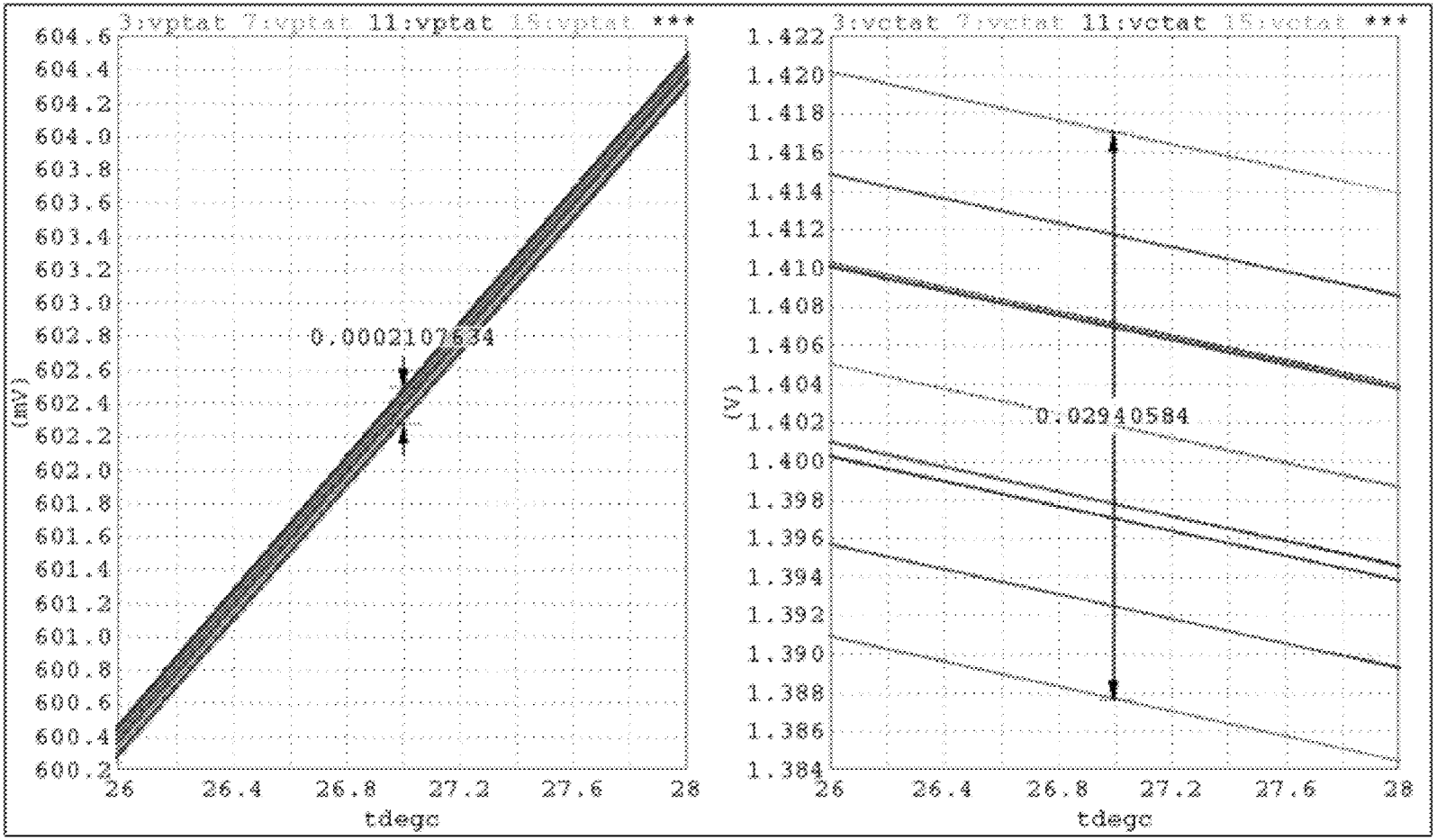
FIG. 7*a* and FIG. 7*b* are graphs showing simulation data of a circuit provided in accordance with the present teaching.
Figure 7B:
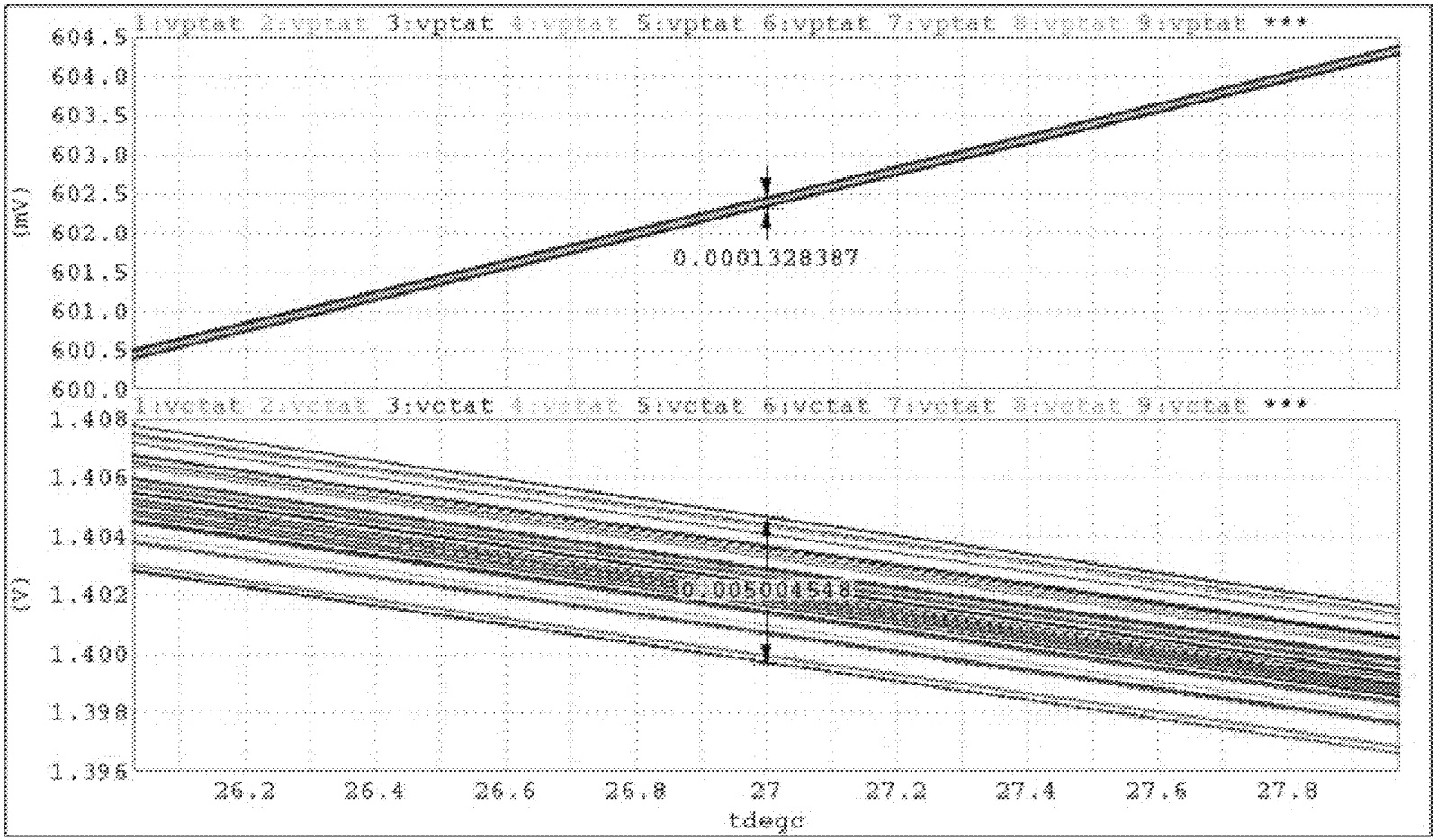

A circuit per the implementation of FIG. 6 was designed and simulated. FIG. 7*a* shows the variation of $V_{PTAT}$ and compound $V_{CTAT}$ voltage components before any trimming was effected to match the actual output of the circuit to the desired 2.5 V output. After judiciously trimming circuit elements it is possible to examine variations in the $V_{PTAT}$ and compound $V_{CTAT}$ voltage components. FIG. 7*b* shows the variation of the output voltage after the application of such an optimization process. The maximum observed temperature coefficient of $V_{OUT}$ was 7.8 ppm/° C. in the −40→125° C. temperature range.

Using circuits per the present teaching it is possible to provide for trimming at a single temperature. It is also possible to provide for trimming at two or more temperatures which may be advantageously employed for more accurate applications. Using an architecture such as that provided in accordance with the present teaching it is possible to provide flexibility in trading performance for manufacturing cost—it will be appreciated that trimming at multiple temperatures will require additional calibration as additional temperature passes are required. It will be understood that dual temperature trim will be better in the form of accuracy, but the differences between dual and single temperature trims is by far not as large as in traditional architectures.

Using a dual temperature process, as a first step the device under test, DUT, is forced to temperature T1 and evaluated. The DUT is then forced to a second temperature T2 and evaluated again. Using the results from these two evaluations it is then possible to determine the value of the output voltage at which the temperature coefficient is a minimum.

By trimming at two different temperatures the accuracy of the circuit output can be improved. The maximum observed temperature coefficient of $V_{OUT}$ was 3.7 ppm/° C. in the −40→125° C. temperature range.

From the above it will be appreciated that the present teaching provides a number of variations on a technique which combines a PTAT and a CTAT cell to provide a voltage reference at an output of the circuit. The circuit uses the PTAT cell to provide an internal voltage reference whose accuracy is provided by the fact that the PTAT component is generated by a differential between two components or elements of the cell which inherently compensate for variations in each other. The output PTAT voltage from the PTAT cell, which is of a form of a proportional to absolute temperature voltage, is very consistent with reduced variability due to process changes and mismatch. If provided in a stack arrangement individual base emitter differentials from each of the cells may be stacked to increase the overall value of the contributing PTAT component without increasing the error. This stacked larger output voltage can then be combined with a CTAT component to remove any temperature dependent effects and provide a voltage reference having, to at least a first order, temperature insensitivities.

Any trimming that is required to the output is effected using the elements that do not contribute to the PTAT cell. The output of the circuit can be modified using trimming techniques that may be implemented in the simplest form by trimming a first set, or indeed multiple sets, of components at a first temperature. By providing trimming at multiple temperatures it is possible to improve the accuracy of the circuit.

It will be appreciated that circuits provided in accordance with the present teaching provide a number of advantages including:

High precision in both absolute value and temperature coefficient;

low noise;

operates in low headroom environment;

operates in low power environments; and can be implemented using less silicon than required for conventional or known arrangements; and depending on the required precision, the circuit might be trimmed at one or two temperatures.

It is however not intended to limit the present teaching to any one set of advantages or features as modifications can be made without departing from the spirit and or scope of the present teaching.

The systems, apparatus, and methods of providing a temperature independent voltage output are described above with reference to certain embodiments. By judiciously combining circuit elements into two or more cells it is possible to use a PTAT component as an internal reference for the overall circuit and modify the output by providing a trimming of a CTAT component. In this way the inherent accurate form of the PTAT component is maintained and the CTAT component is trimmed.

A skilled artisan will, however, appreciate that the principles and advantages of the embodiments can be used for any other systems, apparatus, or methods with a need for a temperature sensitive output.

For example while described with reference to a voltage output, the present teaching may equally be considered suitable for providing a current reference. Using known methodologies it will be appreciated that a PTAT voltage can be changed to a PTAT current should the need arise. For example, a PTAT current can be generated by replicating across a resistor a base-emitter voltage difference of two bipolar transistors operating at different collector current densities. When low current in a small silicon area is to be generated, a MOS transistor operating in its triode region can be used. It will be appreciated that the "on" resistance of a MOS transistor operating in triode region is not well controlled such that if accuracy is required then a use of resistors is preferred.

Additionally, while the base-emitter voltages have been described with reference to the use of specific types of bipolar transistors any other suitable transistor or transistors capable of providing base-emitter voltages could equally be used within the context of the present teaching. It is envisaged that each single described transistor may be implemented as a plurality of transistors the base-emitters of which would be connected in parallel. It will be further appreciated that transistors described herein have all 3 terminals available and as modern CMOS processes have deep N-well capabilities it is possible to use these processes fabricate low quality, but functional vertical npn bipolar transistors.

Such systems, apparatus, and/or methods can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the circuits described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and circuits described herein may be embodied in a variety of other forms. Furthermore, various omissions, substitutions and changes in the form of the methods and circuits described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

What is claimed is:

1. A voltage reference circuit comprising:

a proportional to absolute temperature (PTAT) circuit configured to generate a PTAT signal that is dependent on a base emitter voltage difference between first and second bipolar transistors of the PTAT circuit operating at different current densities;

a complimentary to absolute temperature (CTAT) circuit configured to generate a CTAT signal, and including a first trim point configured to vary a temperature coefficient of the output voltage of the voltage reference circuit;

wherein the CTAT circuit is operatively coupled to the PTAT circuit to apply the CTAT signal to the PTAT signal to provide, at an output of the voltage reference circuit, an output voltage that is first order temperature insensitive and calibratable by calibrating only the CTAT circuit.

2. The voltage reference circuit of claim 1 wherein the PTAT circuit and the CTAT circuit are operatively coupled in a bridge configuration.

3. The voltage reference circuit of claim 1 including at least one resistor separate from the PTAT circuit and the CTAT circuit, wherein the PTAT circuit provides an internal reference for the circuit and the output voltage of the voltage reference circuit is varied by varying one or more of the at least one resistor and the CTAT circuit relative to the PTAT circuit.

4. The voltage reference circuit of claim 1 wherein the PTAT signal is a PTAT voltage.

5. The voltage reference circuit of claim 4 wherein the CTAT signal is a CTAT voltage.

6. The voltage reference circuit of claim 5 wherein the PTAT voltage and CTAT voltage are coupled to the output of the voltage reference circuit via a first resistor and a second resistor respectively.

7. The voltage reference circuit of claim 6 wherein the first resistor has a fixed value and the second resistor has a variable value which is trimmable to vary the output voltage.

8. The voltage reference circuit of claim 1 wherein the CTAT signal is a CTAT current.

9. The voltage reference circuit of claim 8 wherein the PTAT signal is a PTAT voltage and the output voltage of the voltage reference circuit is a combination of the PTAT voltage combined with the CTAT current.

10. The voltage reference circuit of claim 9 wherein the output voltage of the voltage reference circuit is operably varied through varying the CTAT current.

11. The voltage reference circuit of claim 9 wherein the CTAT current is coupled to the output of the voltage reference circuit via a CTAT resistor and the value of the CTAT resistor is operably changed to vary the output voltage of the voltage reference circuit.

12. The voltage reference circuit of claim 1 wherein the PTAT signal is a PTAT current and the CTAT signal is a CTAT voltage and wherein the output voltage of the voltage reference circuit is varied through varying the car voltage.

13. The voltage reference circuit of claim 1 wherein the PTAT circuit comprises a first arm and a second arm, the first arm having a first collector current density and the second arm having a second collector current density which is lower than the first collector current density.

14. The voltage reference circuit of claim 13 wherein the PTAT circuit comprises a plurality of circuit elements stacked relative to one another to increase the generated PTAT signal.

15. The voltage reference circuit of claim 1 wherein the CTAT circuit comprises stacked diodes, the stacked diodes operably biased with an adjustable current.

16. The voltage reference circuit of claim 1 including a curvature correction cell coupled to the of CTAT circuit.

17. The voltage reference circuit of claim 16 wherein the curvature correction cell comprises a first arm and a second arm, the first arm having a first collector current density and the second arm having a second collector current density which is lower than the first collector current density, the second arm operably coupled to the PTAT circuit and the CTAT circuit to receive a combination of PTAT and CTAT currents.

18. The voltage reference circuit of claim 17 wherein the combination of PTAT and CTAT currents are trimmable to provide curvature correction to the output voltage.

19. The voltage reference circuit of claim 1 wherein the calibration of the voltage reference circuit is effected using one or more components of the CTAT circuit.

20. The voltage reference circuit of claim 1 wherein the Output of the voltage reference circuit is coupled to an adjustable gain amplifier to provide a buffered output for the voltage reference circuit, wherein the adjustable gain of the adjustable gain amplifier is a second trim point for the voltage reference circuit.

21. The voltage reference circuit of claim 20 wherein trimming the first and the second trim points at a first single temperature provides variance in the temperature coefficient and absolute value of the output voltage of the voltage reference circuit.

22. The voltage reference circuit of claim 21 wherein trimming of the first and second trim points at a second temperature improves accuracy in the temperature coefficient and absolute value of the output voltage of the voltage reference circuit.

23. The voltage reference circuit of claim 20 wherein the adjustable gain amplifier comprises a resistor string provided in a feedback loop between an output of the amplifier and an inverting node of the amplifier, the second trim point being provided within the feedback loop.

24. A voltage reference circuit comprising:

a proportional to absolute temperature (PTAT) circuit configured to generate a PTAT signal that is dependent on abase emitter voltage difference between first and second bipolar transistors of the PTAT circuit operating at different current densities;

a complimentary to absolute temperature (CTAT) circuit configured to generate a CTAT signal, wherein the CTAT circuit includes stacked diodes, the stacked diodes operably biased with an adjustable current;

wherein the PTAT circuit and the CTAT circuit are operatively coupled in a bridge configuration to apply the CTAT signal to the PTAT signal to provide, at an output of the voltage reference circuit, an output voltage of the voltage reference circuit that is first order temperature insensitive.

25. The voltage reference circuit of claim 24 wherein the PTAT circuit is a first leg of the bridge configuration and the CTAT circuit is a second leg of the bridge, wherein the output of the voltage reference circuit is a tapping point coupling the first and second legs to one another.

26. The voltage reference circuit of claim 24 comprising a curvature correction cell coupled to the CTAT circuit.

27. A method of generating a voltage reference comprising:

operatively coupling a proportional to absolute temperature (PTAT) circuit and a complimentary to absolute temperature (CTAT) circuit, wherein the PTAT circuit is configured to generate a PTAT signal that is dependent on a base emitter voltage difference between first and second bipolar transistors of the PTAT circuit operating at different current densities, and the CTAT circuit is configured to generate a CTAT signal;

applying the CTAT signal to the PTAT signal to generate an output voltage of the voltage reference circuit that is first order temperature insensitive;

varying a temperature coefficient of the output voltage of the voltage reference circuit by trimming a first trim point included within the CTAT circuit; and using the PTAT circuit as an internal reference for the voltage reference circuit.

28. The method of claim 27 comprising only calibrating one or more circuit components of the of CTAT circuit to calibrate the voltage reference.

29. The method of claim 28 wherein the calibrating comprises trimming the one or more circuit components of the CTAT circuit.

* * * * *